US006521018B2

(12) United States Patent
Hobbs et al.

(10) Patent No.: US 6,521,018 B2
(45) **Date of Patent: *Feb. 18, 2003**

(54) BLANKETING METALS AND ALLOYS AT ELEVATED TEMPERATURES WITH GASES HAVING REDUCED GLOBAL WARMING POTENTIAL

(75) Inventors: John Peter Hobbs, Lansdale, PA (US); James Francis Heffron, Orwigsburg, PA (US); Andrew Joseph Woytek, Allentown, PA (US); Zbigniew Zurecki, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/781,099

(22) Filed: Feb. 9, 2001

(65) Prior Publication Data

US 2001/0027702 A1 Oct. 11, 2001

Related U.S. Application Data

(63) Continuation-in-part of application No. 09/499,593, filed on Feb. 7, 2000, now Pat. No. 6,398,844.

(51) Int. Cl.[7] ..... C22B 9/05
(52) U.S. Cl. ..... 75/585; 420/590
(58) Field of Search ..... 75/585; 420/590

(56) References Cited

U.S. PATENT DOCUMENTS

| | | | | | |
|---|---|---|---|---|---|
| 1,972,317 | A | | 9/1934 | Reimers | 75/17 |
| 3,687,626 | A | | 8/1972 | Woole et al. | 423/468 |
| 3,958,981 | A | | 5/1976 | Forberg et al. | 75/68 R |
| 4,082,839 | A | | 4/1978 | Eibeck et al. | 423/489 |
| 4,214,899 | A | * | 7/1980 | Radzilowski | 420/83 |
| 4,770,697 | A | | 9/1988 | Zurecki | 75/68 |
| 4,990,183 | A | | 2/1991 | Anderson et al. | 75/555 |
| 5,518,221 | A | | 5/1996 | Zurecki et al. | 266/44 |
| 5,855,647 | A | * | 1/1999 | Li et al. | 423/155 |
| 6,079,477 | A | | 6/2000 | Woodhouse | 164/76.1 |

FOREIGN PATENT DOCUMENTS

| | | | |
|---|---|---|---|
| DE | 1981555 | 12/1998 | |
| EP | 0964068 | 12/1999 | |
| FR | 2047250 | 3/1971 | |
| JP | 60260434 | 12/1985 | |
| WO | 9902287 | 1/1999 | |
| WO | 0000311 | 1/2000 | B22D/17/00 |

OTHER PUBLICATIONS

Berezkin et al, "Gas Chromatographic Determination of Volatile Sulfur Fluorides in Air", pp. 997–1001, translated from Zhurnal Analiticheskoi Khimii, vol. 39, No. 7. Jul. 1984.*

Schemm, "Sulphur Hexafluoride as Protection against Oxidation of Magnesium Melts" in Giesserei, vol. 58, Sep. 1971. pp. 558–565.*

EP Search Report dated Jun. 13, 2002.

"*Recommended Practices for the Conservation of Sulfur . . .*" International Magnesium Assn., 1998, Technical Committee Report, No Month.

* cited by examiner

*Primary Examiner*—Roy King
*Assistant Examiner*—Tima McGuthry-Banks
(74) *Attorney, Agent, or Firm*—Geoffrey L. Chase

(57) ABSTRACT

An improved method of processing a nonferrous metal and alloys of said metal using a blanketing gas having a global warming potential is provided. The improvement involves reducing the global warming potential of the blanketing gas by blanketing the nonferrous metal and alloys with a gaseous mixture including at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$.

30 Claims, No Drawings

BLANKETING METALS AND ALLOYS AT ELEVATED TEMPERATURES WITH GASES HAVING REDUCED GLOBAL WARMING POTENTIAL

CROSS-REFERENCE TO RELATED APPLICATIONS

This application is a continuation-in-part of application Ser. No. 09/499,593, entitled "Blanketing Molten Nonferrous Metals and Alloys With Gases Having Reduced Global Warming Potential," filed Feb. 7, 2000, now U.S. Pat. No. 6,398,844.

BACKGROUND OF THE INVENTION

The present invention pertains to the blanketing of metals and alloys with gaseous mixtures, and in particular to a method of blanketing metals and alloys at elevated temperatures using gases having reduced global warming potentials relative to the prior art.

Open top vessels such as crucible and induction furnaces used to melt nonferrous metals are operated so that the surface of metal during melting and the surface of the molten bath are exposed to ambient atmosphere. Air in the atmosphere tends to oxidize the melt, thereby: causing loss of metal, loss of alloying additions and formation of slag that causes difficulty in metal processing; shortening refractory life; and promoting nonmetallic inclusions in final castings, pickup of unwanted gases in the metals, porosity, and poor metal recovery. One solution is to enclose the melt furnace in a vacuum or atmosphere chamber for melting and/or processing of the metals. However, completely enclosed systems are very expensive and limit physical and visual access to the metals being melted.

As alternatives, liquid fluxing salts, synthetic slag, charcoal covers, and similar methods and compounds have been used in the high-volume, cost-sensitive field of metal reprocessing for minimizing metal oxidation, gas pickup, and loss of alloying additions. For example, the prior art teaches that rapid oxidation or fire can be avoided by the use of fluxes that melt or react to form a protective layer on the surface of the molten metal. However, this protective layer of thick slag traps good metal, resulting in a loss of up to 2% of the melt. It also can break up and be incorporated into the melt, creating damaging inclusions. In addition, metal in the slag is leachable and creates a hazardous waste product.

These prior art techniques also necessitate additional handling and processing, and cause disposal problems. These techniques often reduce furnace life or ladle refractory life, increase frequency of shutdowns for relining or patching of refractories, and produce non-metallic inclusions that have to be separated from the metal bath prior to pouring of the metal into a cast shape.

In searching for solutions to the above-described problems, metallurgical industries turned to inert gas atmosphere blanketing. One type of gas blanketing system is based on gravitational dispersion of cryogenically-liquified inert gas over the surface of a hot metal to be blanketed. For example, such cryogenic blanketing systems are disclosed and claimed in U.S. Pat. No. 4,990,183.

U.S. Pat. No. 5,518,221 discloses a method and apparatus for inerting the interior space of a vessel containing hot liquids or solids in induction furnaces, crucible furnaces or ladles during charging, melting, alloying, treating, superheating, and pouring or tapping of metals and metal alloys. The method and apparatus employ a swirl of inert gas to blanket or cover the surface of the metal from the time of charging of the furnace until the furnace is poured or tapped or inerting of the molten metal contained in a furnace or ladle or other vessel. The gas swirl is confined by a unique apparatus mounted on top of the furnace or vessel containing the material to be protected. Any inert gas that is heavier than air can be used to practice the invention. In addition to argon and nitrogen, depending upon the material being blanketed, gases such as carbon dioxide and hydrocarbons may be used.

While some cryogenic blanketing systems are quite effective, use of such systems is limited to metallurgical facilities and vessels that can be supplied by well-insulated cryogenic pipelines or equipped with cryogenic storage tanks in close proximity to the point of use of the liquid cryogen. This is not always practical, and some cryogenic blanketing systems have been plagued by poor efficiency due to premature boil-off of the cryogenic liquid and over-simplified design of dispersing nozzles that wasted the boiled-off gas.

Moreover, cryogenic dispensers often fail to uniformly disperse the cryogenic liquid over the blanketed surface, leading to a transient accumulation or entrapment of the liquid in pockets under the slag or dross, which may result in explosions in a subsequent rapid boil-off.

Other approaches have been taken for different molten metals and alloys in further attempts to solve the above-described problems. For example, U.S. Pat. No. 4,770,697 discloses a process for protecting an aluminum-lithium alloy during melting, casting and fabrication of wrought shapes by enveloping the exposed surfaces with an atmosphere containing an effective amount of a halogen compound (e.g., dichlorodifluoromethane) having at least one fluorine atom and one other halogen atom; the other halogen atom is selected from the group consisting of chlorine, bromine, and iodine, and the ratio of fluorine to the other halogen atom in the halogen compound is less than or equal to one. A passivating and self-healing viscous liquid layer is formed which protects the alloy from lithium loss due to vaporization, oxidation of the alloy, and hydrogen pick-up by the alloy.

Another approach for some molten metals, such as magnesium, is to use inhibitors in the air. The early practice was to burn coke or sulfur to produce a gaseous agent, $CO_2$ or $SO_2$. An atmosphere of $CO_2$ was found to be superior to the commonly used commercial atmospheres of $N_2$, Ar, or He because of the absence of vaporization of the magnesium, the absence of excessive reaction products, and the reduced necessity for the enclosure above the molten metal to be extremely air tight.

However, the use of these inhibitors has several drawbacks. For example, both $CO_2$ and $SO_2$ pose environmental and health problems, such as breathing discomfort for personnel, residual sludge disposal, and a corrosive atmosphere detrimental to both plant and equipment. Furthermore, $SO_2$ is toxic, corrosive, and can cause explosions.

While $BF_3$ has been mentioned as being a very effective inhibitor, it is not suitable for commercial processes because it is extremely toxic and corrosive. Sulfur hexafluoride ($SF_6$) also has been mentioned as one of many fluorine-containing compounds that can be used in air as an oxidation inhibitor for molten metals, such as magnesium. A summary of industry practices for using $SF_6$ as a protective atmosphere, ideas for reducing consumption and emissions, and comments on safety issues related to reactivity and health are provided in "*Recommended Practices for the Conservation of Sulfur Hexafluoride in Magnesium Melting Operations*," published by the International Magnesium Association (1998) as a "Technical Committee Report" (hereinafter "IMA Technical Committee Report").

The use of pure $SF_6$ was generally discarded because of its severe corrosive attack on ferrous equipment. In addition, the use of pure $SF_6$ for protecting molten metals such as magnesium has been reported to have caused explosions. Although sulfur hexafluoride ($SF_6$) is considered physiologically inert, it is a simple asphyxiant which acts by displacing oxygen from the breathing atmosphere.

Later, it was found that at low concentrations of $SF_6$ in air (<1%), a protective thin film comprising MgO and $MgF_2$ is formed on the magnesium melt surface. Advantageously, even at high temperatures in air, $SF_6$ showed negligible or no reactions.

However, the use of $SF_6$ and air has some drawbacks. The primary drawback is the release to the atmosphere of material having a high global warming potential (GWP).

It also was found that $CO_2$ could be used together with $SF_6$ and/or air. A gas atmosphere of air, $SF_6$, and $CO_2$ has several advantages. First, this atmosphere is non-toxic and non-corrosive. Second, it eliminates the need to use salt fluxes and the need to dispose of the resulting sludge. Third, using such an atmosphere results in lower metal loss, elimination of corrosion effects, and clean castings. Fourth, a casting process using such an atmosphere provides a clean operation and improved working conditions. Fifth, the addition of $CO_2$ to the blanketing atmosphere reduces the concentration of $SF_6$ at which an effective inerting film is formed on the metal. In sum, the addition of $CO_2$ to an air/$SF_6$ atmosphere provides much improved protection compared to the protection obtained with an air/$SF_6$ atmosphere.

However, using an atmosphere of $SF_6$ and $CO_2$ also has disadvantages. Both $SF_6$ and $CO_2$ are greenhouse gases, i.e., each has a global warming potential over 100 years ($GWP_{100}$). Thus, there is a need to reduce the amounts of $SF_6$ and $CO_2$ released into the atmosphere. $SF_6$ has a 100-year global warming potential ($GWP_{100}$) of 23,900 relative to $CO_2$. International concern over global warming has focused attention on the long atmospheric life of $SF_6$ (about 3,200 years, compared to 50–200 years for $CO_2$) together with its high potency as a greenhouse gas (23,900 times the $GWP_{100}$ of $CO_2$ on a mole basis) and has resulted in a call for voluntary reductions in emissions. Because of this, the use of $SF_6$ is being restricted and it is expected to be banned in the near future. In addition, $SF_6$ is a relatively expensive gas.

Some of the best alternatives to $SF_6$ for blanketing gases would be perfluorocarbons, such as $CF_4$, $C_2F_6$, and $C_3F_8$, but these materials also have high GWP's. Other alternatives would be chlorofluorocarbons (CFC's) or partially fluorinated hydrocarbons (HCFC's). However, the use of CFC's and HCFC's also is restricted; most of these materials are banned as ozone depleters under the Montreal Protocol.

Another alternative to $SF_6$ for a blanketing gas is $SO_2$. When $SO_2$ is used as a blanketing gas, the effective concentration over a melt is typically in the range of about 30% to 70% S02, with about 50% being normal. However, as discussed earlier, $SO_2$ poses environmental and health problems, is toxic, and can cause explosions. In addition, the use of $SO_2$ in such relatively high concentrations can cause corrosion problems on furnace walls.

Even when metals and alloys containing high levels of nonferrous metals, such as alloy AZ61 (5.5–6.5% Al, 0.2–1.0% Zn, 0.1–0.4% Mn, (balance Mg), are exposed to high temperatures for purposes of solution heat treating, annealing, or in preparation for rolling, forging, or other processing, it has been found advantageous to protect the metal or the shape with an atmosphere that will inhibit undesirable surface oxidation or ignition, as is taught in U.S. Pat. No. 6,079,477.

It also has been found desirable to protect such metals and alloys when they are in a highly divided form, such as powders or chips, and are being fed into metals processing systems prior to melting, as is taught in International Publication No. WO 00/00311.

It is desired to have a process for preventing oxidation of molten metals and alloys which overcomes the difficulties and disadvantages of the prior art to provide better and more advantageous results.

It is further desired to have an improved method of processing metals and alloys at elevated temperatures using blanketing gases having lower global warming potentials than the gases used in prior art methods.

It also is desired to have an improved method of processing metals and alloys at elevated temperatures using blanketing gases which overcomes the difficulties and disadvantages of the prior art to provide better and more advantageous results.

BRIEF SUMMARY OF THE INVENTION

A first embodiment of the present invention is an improvement in a method of processing a nonferrous metal and alloys of the metal using a blanketing gas having a global warming potential. The improvement comprises reducing the global warming potential of the blanketing gas by blanketing the nonferrous metal and alloys with a gaseous mixture including at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$and $SF_4$.

There are several variations of the first embodiment of the improvement in the method. In one variation, the at least one compound is provided at a first concentration of less than about 10% on a mole basis of the gaseous mixture. In addition, there may be several variants of that variation. In one variant, the first concentration is less than about 6%. In another variant, the first concentration is less than about 3%. In yet another variant, the first concentration is greater than about 0.1% and less than about 1%.

In another variation, the gaseous mixture further comprises at least one member selected from the group consisting of $N_2$, Ar, $CO_2$, $SO_2$ and air. In a variant of that variation, the at least one member is $CO_2$ provided at a second concentration of about 30% to about 60% on a mole basis. In a variant of that variant, the at least one compound is provided at the first concentration of less than about 3% on a mole basis and is selected from the group consisting of $SO_2F_2$ and $COF_2$.

In yet another variation, the gaseous mixture used in the method also includes an odorant. And in another variation, at least a portion of the gaseous mixture is recovered for reuse.

In still yet another variation, the nonferrous metal and alloys have a temperature of at least about $0.5\times T_{melt}$ (in degrees Kelvin). In addition, there are several variants of this variation. In one variant, the temperature is at least about $0.7\times T_{melt}$ (in degrees Kelvin). In another variant, the temperature is a solidus temperature of the metal and alloys. In yet another variant, the temperature is greater than a solidus temperature of the metal and alloys but less than a liquidus temperature of the metal and alloys. In still yet another variant, the temperature is greater than a liquidus temperature of the metal and alloys but less than about $2.0\times T_{boiling}$ (in degrees Kelvin).

Another aspect of the present invention is a method as in the first embodiment of the improvement in the method, wherein at least one operation is performed on the nonferrous metal and alloys, the at least one operation being selected from the group consisting of melting, holding, alloying, ladling, stirring, pouring, casting, transferring and annealing of the nonferrous metal and alloys.

The present invention also includes an improvement in a method of processing a melt comprising at least one nonferrous metal using a blanketing gas having a global warming potential. The improvement comprises reducing the global warming potential of the blanketing gas by blanketing said melt with a gaseous mixture including at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$.

The present invention also includes a process for preventing oxidation of a nonferrous metal and alloys of the metal. A first embodiment of the process includes blanketing the nonferrous metal and alloys with an atmosphere containing an effective amount of at least one compound selected from the group consisting of $COF_2$, $CF_3COF$, $(CF_3)_2CO$, $F_3COF$, $F_2C(COF)_2$, $SO_2F_2$, $NF_3$, $SO_2ClF$, $SOF_2$, $SOF_4$, NOF, $F_2$ and $SF_4$.

There are several variations of the first embodiment of the process. In one variation, the at least one compound is provided at a first concentration of less than about 10% on a mole basis of the atmosphere. In addition, there may be several variants of that variation. In one variant, the first concentration is less than about 6%. In another variant, the first concentration is less than about 3%. In yet another variant, the first concentration is greater than about 0.1% and less than about 1%.

In another variation, the atmosphere further comprises at least one member selected from the group consisting of $N_2$, Ar, $CO_2$, $SO_2$ and air. In a variant of that variation, the at least one member is $CO_2$ provided at a second concentration of about 30% to about 60% on a mole basis. In a variant of that variant, the at least one compound is provided at the first concentration of less than about 3% on a mole basis and is selected from the group consisting of $SO_2F_2$ and $COF_2$.

In yet another variation, the atmosphere used in the process also includes an odorant. And in another variation, at least a portion of the atmosphere is recovered for reuse.

In still yet another variation, the nonferrous metal and alloys have a temperature of at least about $0.5\times T_{melt}$ (in degrees Kelvin). In addition, there are several variants of this variation. In one variant, the temperature is at least about $0.7\times T_{melt}$ (in degrees Kelvin). In another variant, the temperature is a solidus temperature of the metal and alloys. In yet another variant, the temperature is greater than a solidus temperature of the metal and alloys but less than a liquidus temperature of the metal and alloys. In still yet another variant, the temperature is greater than a liquidus temperature of the metal and alloys but less than about $2.0\times T_{boiling}$ (in degrees Kelvin).

Another aspect of the present invention is a process as in the first embodiment of the process, wherein at least one operation is performed on the nonferrous metal and alloys, the at least one operation being selected from the group consisting of melting, holding, alloying, ladling, stirring, pouring, casting, transferring and annealing of the nonferrous metals and alloys.

The present invention also includes a process for preventing oxidation of a melt including at least one nonferrous metal, the process comprising blanketing the melt with an atmosphere containing an effective amount of at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$.

DETAILED DESCRIPTION OF THE INVENTION

The invention provides a process for preventing oxidation of nonferrous metals or alloys thereof by blanketing the metals or alloys with an atmosphere containing an effective amount of at least one compound having a reduced GWP, preferably selected from the group consisting of $COF_2$, $CF_3COF$, $(CF_3)_2CO$, $F_3COF$, $F_2C(OF)_2$, $SO_2F_2$, $SOF_2$, $SOF_4$, $NF_3$, $SO_2ClF$, NOF, $F_2$ and $SF_4$. The invention also provides an improved method of processing nonferrous metals and alloys thereof using a blanketing gas having a reduced GWP (relative to the prior art) by blanketing the nonferrous metals or alloys with a gaseous mixture including at least one compound having a reduced GWP, preferably selected from the group consisting of $COF_2$, $CF_3COF$, $(CF_3)_2CO$, $F_3COF$, $F_2C(OF)_2$, $SO_2F_2$, $SOF_2$, $SOF_4$, $NF_3$, $SO_2ClF$, NOF, $F_2$ and $SF_4$.

The invention may be applied in many types of operations, including but not limited to the melting, holding, alloying, ladling, stirring, pouring, casting, transferring and annealing of nonferrous metals and alloys thereof. Additional applications include such operations as cladding, plating, rolling, protecting scrap when compacting, preparing powder for improved alloying, protecting reactive metals during electric arc spray coating or any other thermal spray coating, fusing, brazing, and joining/welding operations, and improving the corrosion and wear resistance of articles of magnesium or magnesium based alloys. Persons skilled in the art will recognize other operations where the invention also may be applied.

The gases used in the present invention have lower GWP's than the gases used in the prior art and/or provide greater protection to operators under operating conditions that utilize lower concentrations of the gases. Since the gases used in the present invention are more reactive than $SF_6$, these gases can be used at concentrations supplying an equivalent or lower fluorine level. In other words, if $SF_6$ can be beneficially used at a concentration in the range of about 0.3% to about 1%, then $SO_2F_2$ will have a similar utility at concentrations from about 0.2% to about 3%.

In a preferred embodiment, the selected compound is provided at a concentration of less than about 10% (on a mole basis) of said gaseous mixture. It is more preferable that the concentration be less than about 6%, and it is even more preferable that it be less than about 3%.

However, since $F_2$, ClF, and $ClF_3$ are much more reactive than the other gases used in the present invention, these gases ($F_2$, ClF and $ClF_3$) should only be used at lower concentrations, i.e., at a concentration less than 5% and preferably less than 1%. In particular, if used at higher concentrations (e.g., 10%) in connection with a molten or hot metal, these gases ($F_2$, ClF and $ClF_3$) may ignite and cause a metal/fluorine fire. Also, as shown in Table 1 below, $F_2$, ClF and $ClF_3$ are very toxic. These gases will react relatively indiscriminately with any surfaces exposed to any of these gases, such as iron/steel structures used in melt processes (e.g., melt pots, furnaces, etc.). This could result in relatively thick metal fluoride layers that may increase the risk of "thermite" type reactions, generation of HF upon exposure to atmospheric moisture, and HF burns to operators due to accidental contact with metal fluoride layers.

In a preferred embodiment, the gaseous mixture further comprises at least one member selected from the group consisting of $N_2$, Ar, $CO_2$ and air as a diluent. $SO_2$ also could be used as the diluent, but is less desirable because of potential corrosion problems associated with $SO_2$. In addition, $F_2$ is violently reactive with $SO_2$, which would make it extremely dangerous to use $SO_2$ as a diluent if $F_2$ is present above trace levels.

The most efficacious mixtures for blanketing nonferrous metals contain significant concentrations of $CO_2$, preferably in the range of about 30% to about 60%. Some nonferrous metals also could benefit from the addition of chlorine or chlorine-containing species (such as $SO_2$-ClF) to the blanketing gas mixture.

For example, in one embodiment, $CO_2$ is the diluent in the blanketing atmosphere at a concentration of about 30% to about 60% on a mole basis, and $SO_2F_2$ is provided at a concentration of less than about 3% on a mole basis. In another embodiment, $CO_2$ is the diluent in the blanketing atmosphere at a concentration of about 30% to about 60% on a mole basis, and $COF_2$, either alone or in combination with $SO_2F_2$, is provided in a concentration of less than about 3% on a mole basis (referring to $COF_2$).

In a preferred embodiment, an odorant is added for safety purposes to the mixture used for the blanketing atmosphere. This is especially preferred for odorless gases, such as $SO_2F_2$. In contrast, since $F_2$, $SOF_2$ and $SF_4$ have distinctive odors, the addition of an odorant is less important when these gases are used. The same is true when $SO_2$ is used as a diluent because of the odor of $SO_2$.

Table 1 compares the preferred gases used in the present invention to various gases used in the prior art with regard to GWP and other characteristics. Several gases which technically could be used in the present invention, but are likely to be too expensive or too reactive to use, include ClF, $ClF_3$, $CF_3COCl$, $(CF_3)_2NH$, and $CF_2(O)CFCF_3$.

TABLE I

| Name | Formula | CAS Number(1) | OSHA PEL/ Ceiling/ Max Peak(2) | ACGIH TWA/STEL(3) | $GWP_{100}$(4) | Atmospheric Lifetime years | Odor (detection limit in ppm) |
|---|---|---|---|---|---|---|---|
| Sulfur Hexafluoride | $SF_6$ | 2551-62-4 | 1,000/x/x | 1,000/1,250 | 24,900 | 3,200 | Odorless |
| Sulfur Dioxide | $SO_2$ | 7446-09-5 | 2/5/x | 10/15 | −1(5) | NK(6) | Irritating Acid (3-5) |
| Carbon Dioxide | $CO_2$ | 124-38-9 | 5,000/30,000 | asphyxiant | 1 | 50–200 | Odorless |
| Perfluoromethane | $CF_4$ | 75-73-0 | X | asphyxiant | 6,500 | 50,000 | Odorless |
| Perfluoroethane | $C_2F_6$ | 76-16-4 | X | asphyxiant | 9,200 to 12,500 | 10,000 | Odorless |
| Perfluoropropane | $C_3F_8$ | 76-19-7 | X | asphyxiant | 6,950 | 7,000 | Odorless |
| Sulfuryl Fluoride | $SO_2F_2$ | 2699-79-8 | 5/10/x | toxic | ~1 | NK | Odorless |
| Thionyl Fluoride Sulfinyl Fluoride | $SOF_2$ | 7783-84-8 | X | toxic | ~1 | NK | Suffocating |
| Sulfur Oxifluoride | $SO_2F_4$ | 13709-54-1 | X | toxic | ~1 | NK | NK |
| Sulfur Tetraflouride | $SF_4$ | 7783-60-0 | x/0.1/x | 0.1/0.3 | ~1 | NK | Like $SO_2$ |
| Nitrogen Triflouride | $NF_3$ | 7783-54-2 | 10/x/x | 10/15 | 8,000 to 9,720 | 180 to 740 | Moldy |
| Nitrosyl Fluoride | NOF | 7789-25-5 | X | toxic | ~1 | NK | NK |
| Sulfuryl Chloride Fluoride | $SO_2ClF$ | 13637-84-8 | X | toxic | ~1 | NK | NK |
| Carbonyl Fluoride | $COF_2$ | 353-50-4 | 2/5 | 2/5 | ~1 | 50–200 | Sharp HF Irritating |
| Trifluoro acetyl Fluoride | $CF_3COF$ | 354-34-7 | X | toxic | NK | NK hydrolizes | NK |
| Trifuoro acetyl chloride | $CF_3COCl$ | 354-32-5 | X | toxic | NK | NK hydrolizes | NK |
| Hexafluoro-acetone | $(CF_3)_2CO$ | 684-16-2 | X | toxic 0.1 PPM skin | NK | NK | NA(7) |
| Hexafluoro-acetone | $(CF_3)_2NH$ | 1645-75-6 | X | toxic | NK | NK | NA |
| Fluoroxy-trifluoromethane | $F_3COF$ | 373-91-1 | X | toxic | ~1 | 50–200 hydrolizes to $CO_2$ | Sharp HF Irritating |
| Bisfluoroxy-difluoromethane | $F_2C(OF)_2$ | 16282-67-0 | X | toxic | ~1 | 50–200 hydrolizes to $CO_2$ | Sharp HF Irritating |
| Hexafluoro-propene oxide | $CF_2(O)CFCF_3$ | 428-59-1 | X | toxic | NK | NK | NA |
| Fluorine | $F_2$ | 7782-41-4 | 0.1 | 1/2 | ~0 | <1 hydrolizes | Sharp Pungent Irritating |

TABLE I-continued

| Name | Formula | CAS Number(1) | OSHA PEL/ Ceiling/ Max Peak(2) | ACGIH TWA/STEL(3) | $GWP_{100}$(4) | Atmospheric Lifetime years | Odor (detection limit in ppm) |
|---|---|---|---|---|---|---|---|
| Chlorine | $Cl_2$ | 7782-50-5 | 0.5/1.0 | 1/3 | ~0 | <1 hydrolizes | Disagreeable Suffocating |
| Chlorine Fluoride | ClF | 7790-89-8 | Not established toxic | toxic | ~0 | <1 hydrolizes | Acid Halogen odor VERY sharp pungent |
| Chlorine Trifluoride | $ClF_3$ | 7790-91-2 | /0.1 | /0.1 | ~0 | <1 hydrolizes | Sweet Suffocating |

Table 1 Notes:
(1)"CAS" is Chemical Abstract Services.
(2)"OSHA" is Occupational Safety and Health Administration; and
"PEL" is Permissible Exposure Limit in parts per million (ppm), 29 CFR 1910.1000.
(3)"ACGIH" is American Conference of Governmental Industrial Hygienists;
"TWA" is Time Weighted Average in parts per million (ppm); and
"STEL" is Short Term Exposure Limit in parts per million (ppm).
(4)"GWP100" is Global Warming Potential relative to that of CO2 estimated over 100 years; for example, the $GWP_{100}$ of $SF_6$ is 24,900 times the $GWP_{100}$ of $CO_2$. Applicants are not aware of any published data regarding the GWP's for the compounds for which the $GWP_{100}$ is indicated to be ~1.
(5)Atmospheric reactions of $SO_2$ produce sulfate aerosols. These aerosols result in negative radiative forcing, ie. tend to cool the earth's surface, but also are a major source of acid rain.
(6)"not known (NK)"; the atmospheric lifetime of these species are not known to the applicants, but are believed to be comparable to that of $CO_2$.
(7)"not available (NA)"

The comparison of $GWP_{100}$ shows that ten of the thirteen preferred gases used in the present invention ($COF_2$, CF3COF, $(CF3)_2CO$, $F_3COF$, $F_2C(OF)_2$, $SO_2F_2$, $NF_3$, $SO_2ClF$, $SF_4$, $SOF_2$ NOF, $F_2$ and $SOF_4$) have significantly lower $GWP_{100}$'s than the gases used in the prior art. (Of the thirteen gases, only $NF_3$ has a $GWP_{100}$ greater than ~1; but the $GWP_{100}$ of $NF_3$ is still several fold lower than the $GWP_{100}$ of $SF_6$, and the atmospheric life of $NF_3$ also is shorter than that of $SF_6$. For two of the other gases, $CF_3$ COF and $(CF_3)_2CO$, the $GWP_{100}$'s are not known.) Furthermore, the prior art did not teach or even appreciate the possible use of these gases for blanketing. For example, the IMA Technical Committee Report shows that $SO_2F_2$ and $SF_4$ are by-products of the $SF_6$ protective chemistry for magnesium, but that report fails to realize that both $SO_2F_2$ and $SF_4$ can be potent sources of fluorine for protection of the melt. The gases used in the present invention may be recovered and recycled for reuse. Recovery techniques that may be used include the use of membranes, absorption, condensing and other means to concentrate the desirable gases for reuse.

While the present invention has been described in detail with reference to certain specific embodiments, the invention is nevertheless not intended to be limited to the details described. Rather, it will be apparent to persons skilled in the art that various changes and modifications can be made in the details within the scope and range of the claims and without departing from the spirit of the invention and the scope of the claims.

What is claimed is:

1. In a method of processing a nonferrous metal and alloys of said metal using a blanketing gas having a global warming potential, the improvement comprising reducing said global warming potential of said blanketing gas by blanketing said nonferrous metal and alloys with a gaseous mixture including at least one compound selected from the group consisting of $COF_2$, $CF_3COF$, $(OF_3)_2CO$, $F_3COF$, $F_2C(OF)_2$, $SO_2$ $F_2$, $NF_3$, $SO_2ClF$, $SOF_2$, $SOF_4$, NOF, $F_2$ and $SF_4$, wherein said nonferrous metal and alloys have a temperature of at least about $0.5\times T_{melt}$ in degrees Kelvin, wherein said temperature is greater than a solidus temperature of said metal and alloys but less than a liquidus temperature of said metal and alloys.

2. A method as in claim 1, wherein said at least one compound is provided at a first concentration of less than about 10% on a mole basis of said gaseous mixture.

3. A method as in claim 2, wherein said first concentration is less than about 6%.

4. A method as in claim 2, wherein said first concentration is less than about 3%.

5. A method as in claim 2, wherein said first concentration is greater than about 0.1% and less than about 1%.

6. A method as in claim 2, wherein said gaseous mixture further comprises at least one member selected from the group consisting of $N_2$, Ar, $CO_2$, $SO_2$ and air.

7. A method as in claim 6, wherein said at least one member is $CO_2$ provided at a second concentration of about 30% to about 60% on a mole basis.

8. A method as in claim 7, wherein said at least one compound is provided at said first concentration of less than about 3% on a mole basis and is selected from the group consisting of $SO_2F_2$ and $COF_2$.

9. A method as in claim 1, wherein said temperature is at least about $0.7\times T_{melt}$ in degrees Kelvin.

10. A method as in claim 1, wherein at least a portion of said gaseous mixture is recovered for reuse.

11. In a method of processing a nonferrous metal and alloys of said metal using a blanketing gas having a global warming potential, the improvement comprising reducing said global warming potential of said blanketing gas by blanketing said nonferrous metal and alloys with a gaseous mixture including at least one compound selected from the group consisting of $COF_2$, $CF_3COF$, $(CF_3)_2CO$, $F_3COF$, $F_2C(OF)_2$, $SO_2$ $F_2$, $NF_3$, $SO_2ClF$, $SOF_2$, $SOF_4$, NOF, $F_2$ and $SF_4$, wherein said nonferrous metal and alloys have a temperature of at least about $0.5\times T_{melt}$ in degrees Kelvin, wherein said temperature is a solidus temperature of said metal and alloys.

12. In a method of processing a nonferrous metal and alloys of said metal using a blanketing gas having a global warming potential, the improvement comprising reducing said global warming potential of said blanketing gas by blanketing said nonferrous metal and alloys with a gaseous mixture including at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$, wherein said gaseous mixture further comprises an odorant.

13. A process as in claim 12, wherein said nonferrous metal and alloys have a temperature of at least about $0.5\times T_{melt}$ and said temperature is greater than a liquidus temperature of said metal and alloys but less than about $2.0\times T_{boiling}$.

14. A method as in claim 12, wherein at least one operation is performed on said nonferrous metal and alloys, said at least one operation being selected from the group consisting of melting, holding, alloying, ladling, stirring, pouring, casting, transferring and annealing of said nonferrous metal and alloys.

15. In a method of processing a melt comprising at least one nonferrous metal using a blanketing gas having a global warming potential, the improvement comprising reducing said global warming potential of said blanketing gas by blanketing said melt with a gaseous mixture including at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$ wherein said gaseous mixture further comprises an odorant.

16. A process for preventing oxidation of a nonferrous metal and alloys of said metal comprising blanketing said nonferrous metal and alloys with an atmosphere containing an effective amount of at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$, wherein said nonferrous metal and alloys have a temperature of at least about $0.5\times T_{melt}$ in degrees Kelvin and wherein said temperature is a solidus temperature of said metal and alloys.

17. A process for preventing oxidation of a nonferrous metal and alloys of said metal comprising blanketing said nonferrous metal and alloys with an atmosphere containing an effective amount of at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$, wherein said nonferrous metal and alloys have a temperature of at least about $0.5\times T_{melt}$ in degrees Kelvin, wherein said temperature is greater than a solidus temperature of said metal and alloys but less than a liquidus temperature of said metal and alloys.

18. A process as in claim 17, wherein at least a portion of said atmosphere is recovered for reuse.

19. A process as in claim 1, wherein said at least one compound is provided at a first concentration of less than about 10% on a mole basis of said atmosphere.

20. A process as in claim 19, wherein said first concentration is less than about 6%.

21. A process as in claim 19, wherein said first concentration is less than about 3%.

22. A process as in claim 19, wherein said first concentration is greater than about 0.1% and less than about 1%.

23. A process as in claim 19, wherein said atmosphere further comprises at least one member selected from the group consisting of $N_2$, Ar, $CO_2$, $SO_2$ and air.

24. A process as in claim 23, wherein said at least one member is $CO_2$ provided at a second concentration of about 30% to about 60% on a mole basis.

25. A process as in claim 24, wherein said at least one compound is provided at said first concentration of less than about 3% on a mole basis and is selected from the group consisting of $SO_2F_2$ and $COF_2$.

26. A process as in claim 1, wherein at least one operation is performed on said nonferrous metal and alloys, said at least one operation being selected from the group consisting of melting, holding, alloying, ladling, stirring, pouring, casting, transferring and annealing of said nonferrous metal and alloys.

27. A process for preventing oxidation of a nonferrous metal and alloys of said metal comprising blanketing said nonferrous metal and alloys with an atmosphere containing an effective amount of at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$, wherein said atmosphere further comprises an odorant.

28. A process as in claim 27, wherein said nonferrous metal and alloys have a temperature of at least $0.7\times T_{melt}$.

29. A process as in claim 27, wherein said nonferrous metal and alloys have a temperature of at least about $0.5\times T_{melt}$ and said temperature is greater than a liquidus temperature of said metal and alloys but less than about $2.0\times T_{boiling}$.

30. A process for preventing oxidation of a melt comprising at least one nonferrous metal, said process comprising blanketing said melt with an atmosphere containing an effective amount of at least one compound selected from the group consisting of $COF_2$, $CF_3COF$, $(CF_3)_2CO$, $F_3COF$, $F_2C(OF)_2$, $SO_2F_2$, $NF_3$, $SO_2ClF$, $SOF_2$, $SOF_4$, NOF, $F_2$ and $SF_4$ wherein said atmosphere further comprises an odorant.

* * * * *

UNITED STATES PATENT AND TRADEMARK OFFICE

CERTIFICATE OF CORRECTION

PATENT NO. : 6,521,018 B2 
DATED : February 18, 2003
INVENTOR(S) : John Peter Hobbs et al.

It is certified that error appears in the above-identified patent and that said Letters Patent is hereby corrected as shown below:

Column 9,
Line 64, delete "$(OF_3)_2$" and substitute therefore -- $(CF_3)_2$ --

Column 12,
Lines 3 and 22, delete "1" and substitute therefore -- 17 --

Signed and Sealed this

Eighth Day of July, 2003

JAMES E. ROGAN
*Director of the United States Patent and Trademark Office*